US011608770B2

(12) United States Patent
Hayes

(10) Patent No.: US 11,608,770 B2
(45) Date of Patent: Mar. 21, 2023

(54) HYDRAULIC MOTOR SYSTEM FOR LIQUID TRANSPORT TANK

(71) Applicant: Roger Hayes, Adelanto, CA (US)

(72) Inventor: Roger Hayes, Adelanto, CA (US)

( * ) Notice: Subject to any disclaimer, the term of this patent is extended or adjusted under 35 U.S.C. 154(b) by 0 days.

(21) Appl. No.: 17/305,220

(22) Filed: Jul. 1, 2021

(65) Prior Publication Data

US 2022/0003145 A1 Jan. 6, 2022

Related U.S. Application Data

(60) Provisional application No. 63/046,910, filed on Jul. 1, 2020.

(51) Int. Cl.

| | |
|---|---|
| ***F01P 11/02*** | (2006.01) |
| ***F01P 3/12*** | (2006.01) |
| ***F04D 29/58*** | (2006.01) |
| ***F01P 3/20*** | (2006.01) |

(52) U.S. Cl.

CPC ..... *F01P 11/029* (2013.01); *F01P 3/12* (2013.01); *F01P 3/20* (2013.01); *F04D 29/586* (2013.01); *F04D 29/5806* (2013.01)

(58) Field of Classification Search

CPC .... F01P 11/029; F01P 3/20; F01P 3/12; F04D 29/5806; F04D 29/5826; F04D 29/586; F04D 29/5866; F04D 29/58

See application file for complete search history.

(56) References Cited

U.S. PATENT DOCUMENTS

2013/0272843 A1* 10/2013 Mettler ..... F04D 9/043 415/203

OTHER PUBLICATIONS

Milwaukee Cylinder White Paper—Using Hydraulic Cylinders in High Temperature Environments; copywrite 2016 <https://milwaukeecylin.wpengine.com/wp-content/uploads/2021/11/en-3000_milwaukee_cylinder_vulcan_series_white_paper-comp2.pdf> (Year: 2016).*

Power & Motion—Hydraulic Cylinders Keep Their Cool, Jan. 19, 2017 <https://www.powermotiontech.com/hydraulics/hydraulic-pumps-motors/article/21885384/hydraulic-cylinders-keep-their-cool> (Year :2017).*

* cited by examiner

*Primary Examiner* — Jacob M Amick

(74) *Attorney, Agent, or Firm* — Knobbe Martens Olson & Bear, LLP

(57) ABSTRACT

A motor for driving a liquid end of a pump system. The motor having an inner housing having an outer surface, a mechanical actuator disposed in the inner housing, and a water jacket surrounding at least a portion of the outer surface of the inner housing to define a volume between the inner housing and the water jacket. The volume being sized to circulate water within the water jacket so as to transfer heat from the inner housing to the water.

22 Claims, 12 Drawing Sheets

HYDRAULIC MOTOR SYSTEM FOR LIQUID TRANSPORT TANK

CROSS-REFERENCE TO RELATED APPLICATION

This application claims benefit under 35 U.S.C. 119(e) to U.S. Provisional Patent App. No. 63/046,910, filed Jul. 1, 2020, the entire disclosure of which is hereby incorporated by reference herein in its entirety. Any and all priority claims identified in the Application Data Sheet, or any corrections thereto, are hereby incorporated by reference under 37 CFR 1.57.

FIELD

This disclosure generally relates to hydraulic motor systems for vehicles used for transporting and spraying liquids. The hydraulic motor system drives a pump system which sprays liquid from a tank. More specifically, the hydraulic system is driven by pressurized hydraulic fluid to drive a liquid distribution pump.

BACKGROUND

Tank carrying vehicles are used to transport liquids. The vehicle can include a pump system designed to pump the liquid from inside a tank and spray or expel the pumped liquid at high pressure. A hydraulic system is secured to the chassis of the vehicle in proximity to the tank and drives the pump system.

SUMMARY

The devices of the present invention have several features, no single one of which is solely responsible for its desirable attributes. Without limiting the scope of this invention as expressed by the claims which follow, its more prominent features will now be discussed briefly. After considering this discussion, and particularly after reading the section entitled "Detailed Description," one will understand how the features of this invention provide several advantages over current designs.

An aspect of the present disclosure provides a hydraulic motor for driving a liquid end of a pump system. The pump system is supported by a tank. The tank transports and sprays liquid. The hydraulic motor comprises a housing having an outer surface and a mechanical actuator disposed in the housing. The mechanical actuator converts hydraulic pressure of a fluid into torque and angular displacement. The motor further comprises an inlet port and an outlet port in the outer surface and in flow communication with the mechanical actuator. The inlet port is configured to supply the fluid to the mechanical actuator. The outlet port is configured to return the fluid leaving the mechanical actuator. The motor further comprises a drain port in the outer surface, an output shaft for transferring the torque and angular displacement to the liquid end of the pump system, and a flange coupled to the housing and configured to be secured relative to the liquid end of the pump system. The motor further comprises a water jacket surrounding at least a portion of the outer surface of the housing and having a water inlet and a water outlet, a first pipe extending from the inlet port and through the water jacket, the first pipe having a first connector configured to releasably couple to a hydraulic supply line, a second pipe extending from the outlet port and through the water jacket, the second pipe having a second connector configured to releasably couple to a hydraulic return line, and a third pipe extending from the drain port and through the water jacket, the third pipe having a third connector configured to releasably couple to a drain line.

In further aspects, the water inlet and the water outlet are configured to connect to the tank to circulate water between the tank and the water jacket.

In further aspects, a flow area of the water inlet is less than a flow area of the water outlet.

In further aspects, the water jacket is sized greater than a size of the inner housing to allow water from the tank to circulate around the inner housing as the water flows from the water inlet to the water outlet.

In further aspects, the water jacket has a cylindrical shape.

In further aspects, the water jacket comprises aluminum.

In further aspects, one or more fasteners are configured to couple the flange of the housing relative to the liquid end.

Another aspect of the present disclosure provides a hydraulic motor for driving a liquid end of a pump system. The hydraulic motor comprises an inner housing having an outer surface, a mechanical actuator disposed in the inner housing, a coolant jacket surrounding at least a portion of the outer surface of the inner housing, and an inlet port and an outlet port in flow communication with the mechanical actuator and accessible from outside the coolant jacket.

In further aspects, the coolant jacket comprises an inlet and an outlet, and wherein the inlet and the outlet are configured to connect to a tank to circulate water between the tank and inside the coolant jacket.

In further aspects, a first pipe extends from the inlet port and through the water jacket and a second pipe extends from the outlet port and through the water jacket.

In further aspects, a first connector is configured to releasably couple the first pipe to a hydraulic supply line and a second connector is configured to releasably couple the second pipe to a hydraulic return line.

In further aspects, a flange is coupled to the inner housing and configured to be secured relative to the liquid end of the pump system.

Another aspect of the present disclosure provides a hydraulic motor for driving a liquid end of a pump system. The hydraulic motor comprises an inner housing having an outer surface, a mechanical actuator disposed in the inner housing, and a coolant jacket surrounding at least a portion of the outer surface of the inner housing to define a volume between the inner housing and the coolant jacket.

In further aspects, the volume is sized to circulate coolant within the coolant jacket so as to transfer heat from the inner housing to the coolant.

In further aspects, the coolant is water.

In further aspects, the coolant jacket comprises an inlet and an outlet, and wherein the coolant circulated within the coolant jacket enters the volume via the inlet and exits the volume via the outlet.

In further aspects, the inlet and the outlet are further configured to connect to a tank to circulate the coolant between a tank and inside the coolant jacket.

In further aspects, the pump system comprises a centrifugal pump.

In further aspects, the hydraulic motor comprises an inlet and an outlet, and wherein the inlet and the outlet are configured to provide a flow path for a working fluid to flow between a reservoir and the hydraulic motor.

Another aspect of the present disclosure provides a coolant jacket for surrounding at least a portion of an inner housing of a hydraulic motor to form a volume between the inner housing and an inside surface of the coolant jacket.

The hydraulic motor includes a mechanical actuator and is configured to drive a liquid end of a pump system.

In further aspects, the coolant jacket is sized and shaped relative to the inner housing to circulate coolant within the coolant jacket so as to transfer heat from the inner housing to the coolant.

In further aspects, the volume is configured to be in flow communication with a tank to circulate the coolant between the tank and inside the coolant Further aspects, features and advantages of the present invention will become apparent from the detailed description that follows.

BRIEF DESCRIPTION OF THE DRAWINGS

Various examples are depicted in the accompanying drawings for illustrative purposes and should in no way be interpreted as limiting the scope of the examples. Various features of different disclosed examples can be combined to form additional examples, which are part of this disclosure.

DETAILED DESCRIPTION

The various features and advantages of the systems, devices, and methods of the technology described herein will become more fully apparent from the following description of the examples illustrated in the figures. These examples are intended to illustrate the principles of this disclosure, and this disclosure should not be limited to merely the illustrated examples. The features of the illustrated examples can be modified, combined, removed, and/or substituted as will be apparent to those of ordinary skill in the art upon consideration of the principles disclosed herein.

Figure 1:
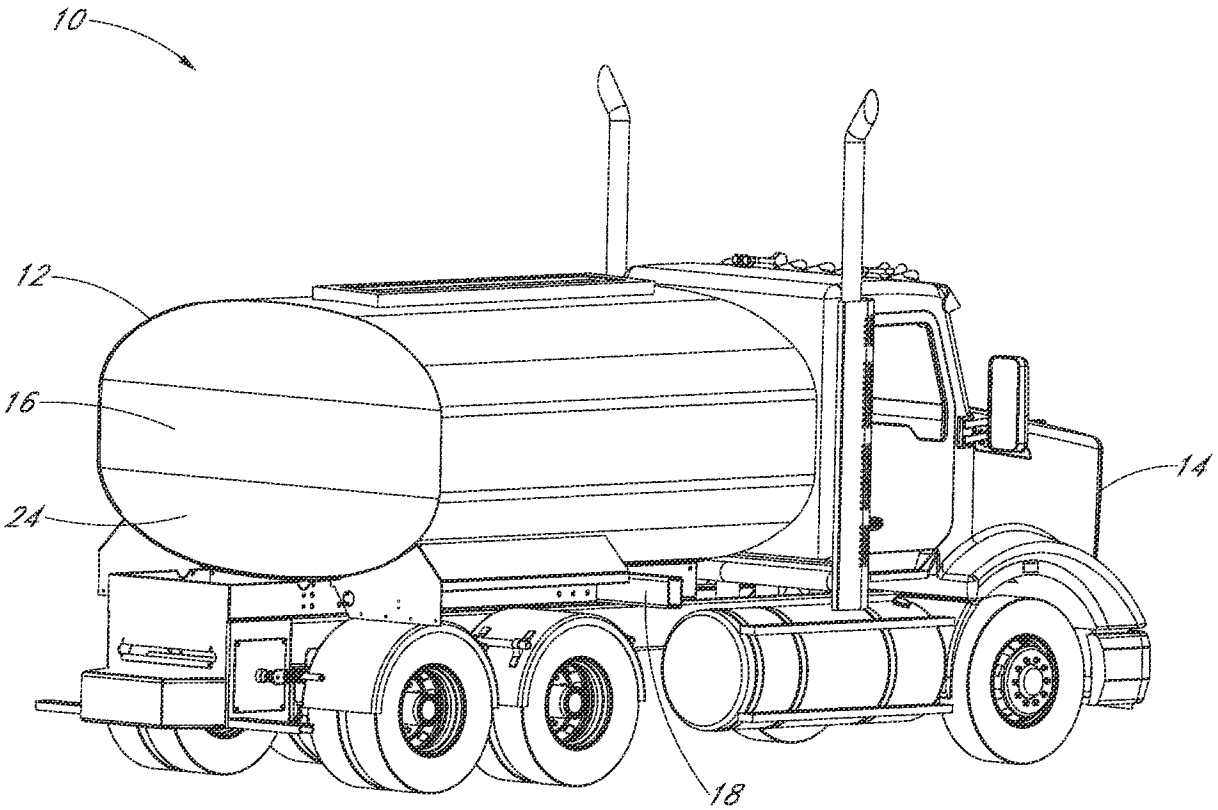
FIG. 1 is a perspective view of a truck including a tank body supported by a chassis.
Figure 2:
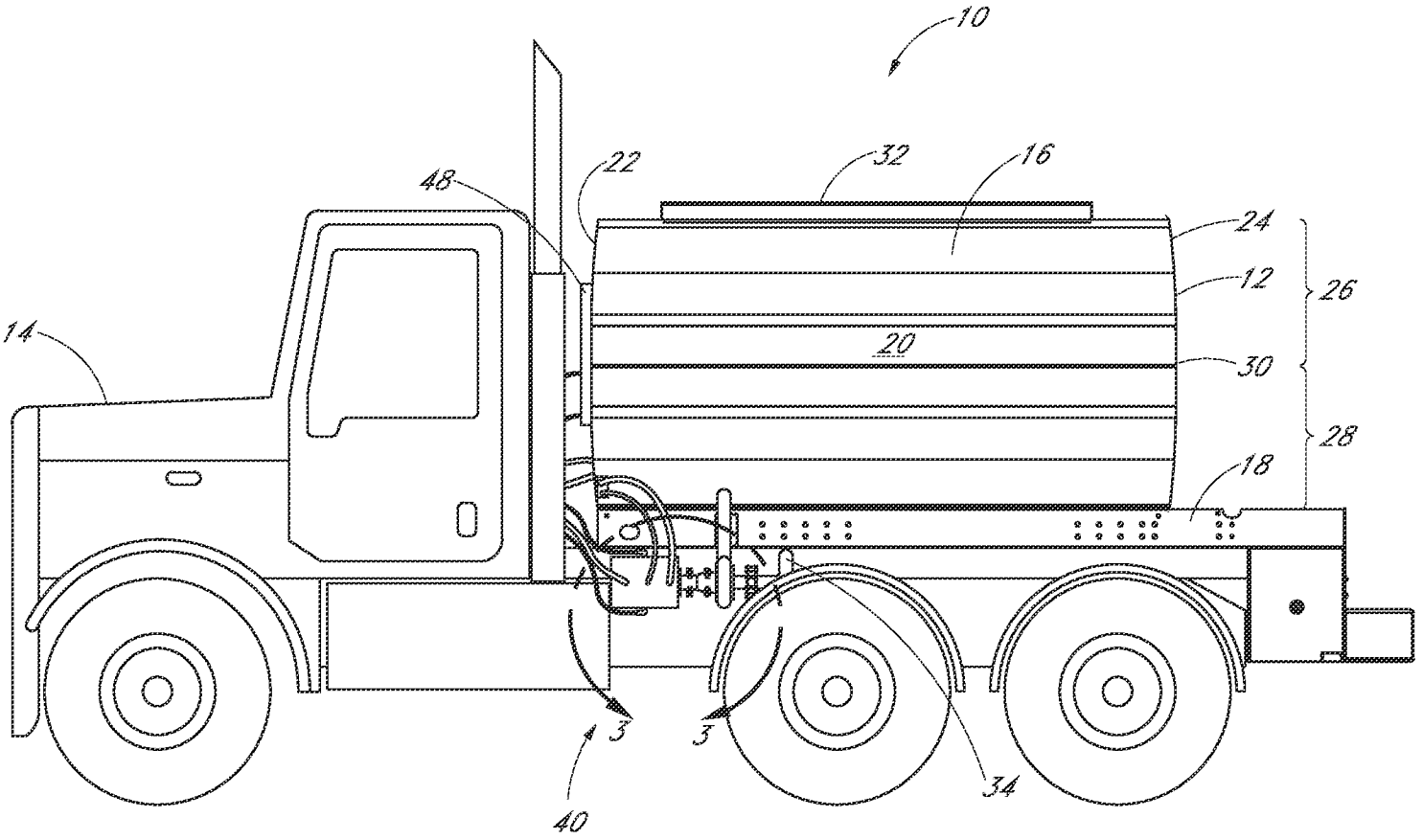
FIG. 2 is a plan view of a left side of the truck from FIG. 1 showing a pump system that includes a liquid end and a power frame according to a preferred embodiment of the present invention.

FIG. 1 is a perspective view of a truck 10 including a tank body 12 supported by a chassis 14. The truck 10 can be a motor vehicle or other transportation means. In certain embodiments, the tank body 12 can comprise a tank 16 supported by a frame 18. FIG. 2 is a plan view of a left side of the truck 10 from FIG. 1 showing a pump system 40 according to certain embodiments.

The tank 16 can have various uses. For example, the tank 16 can be used in the petroleum industry for the storage or transportation of fuel or oil in liquid form. Other exemplary uses include storage or transportation of liquids in the farming, forestry, construction, mining, chemical, water, or other industries.

In certain embodiments, the tank 16 can rest on the frame 18. In certain embodiments, the tank 16 can be attached with the frame 18, either permanently or temporarily. In this way, the frame 18 can be used for supporting, storing and/or transporting the tank 16.

The tank 16 includes an outer wall 20. The outer wall 20 can encase an interior space forming a receptacle. In certain embodiments, the receptacle can be used for storage of a liquid. In certain embodiments, the outer wall 20 can contain the liquid. The receptacle can optionally be filled with the liquid and emptied of the liquid as explained below.

In certain embodiments, the outer wall 20 is formed from a single panel. In other embodiments, the outer wall 20 can include a plurality of panels. In certain embodiments, at least a portion of the outer wall 20 is 10 gauge in thickness. In certain embodiments, at least a portion of the outer wall is 11 gauge in thickness. Of course, the thickness of the outer wall 20 is not limited to the listed gauges or to only a single gauge and can be any other gauge or combination of thicknesses.

In certain embodiments, the panels can be curved and/or have flat regions that together form the outer wall 20 that encloses the receptacle. In certain embodiments, the outer wall 20 can have a form factor. The form factor can generally be or include rectangular, circular, hexagonal, elliptical, polygonal, irregular, or any other suitable prism shapes.

In certain embodiments, the outer wall 20 can form a one-piece tank or a multi-piece tank as explained below. In embodiments of a one-piece tank as is illustrated in FIG. 1, the outer wall 20 is formed into the shape of the tank 16. For example, the tank 16 can be manufactured to include a front head 22 and a rear head 24 welded to a central body.

In embodiments of the tank 16, the outer wall 20 can comprises a top portion 26 and a bottom portion 28. In certain embodiments, the top portion 26 and the bottom portion 28 can cooperate to enclose the receptacle. For example, the top portion 26 and the bottom portion 28 can be welded together along with the front head 22 and the rear head 24 to form a one-piece tank.

In certain embodiments, the top portion 26 and the bottom portion 28 can each include a singular piece and/or a single material. For example, the top portion 26 and the bottom portion 28 can include steel, stainless steel, galvanized steel, plastic, aluminum, fiberglass, Strenex, chrome-ally, galvanneal, enduraplas, or any other suitable material.

In certain embodiments, the top portion 26 and the bottom portion 28 can be formed out of a plurality of connected panels. In some implementations, the material of the top portion 26 can be the same as the material of the bottom portion 28. In other implementations, the top portion 26 can be a different material than the bottom portion 28. In certain implementations, the bottom portion 28 is a steel or stainless steel and the top portion 26 is a fiberglass material. In certain implementations, the bottom portion 28 is a stainless steel and the top portion 26 is a steel. Any other combination of the above materials including any other suitable material is contemplated herein.

In certain embodiments, the top portion 26 and the bottom portion 28 can connect at an interface 30. In certain embodiments, the interface 30 can extend along a horizontal plane dividing the top portion 26 from the bottom portion 28. In other implementations, the interface 30 can be located within multiple different planes. In other implementations, the interface 30 can include multiple protrusions and interlocking valleys. In other implementations, the interface 30 can be located within a non-horizontal plane.

In certain embodiments, the top portion 26 and the bottom portion 28 can be permanently attached together at the interface 30 such as by welding, or releasably attached at the interface 30 such as with mechanical fasteners to connect and/or otherwise releasably seal together the top portion 26 and the bottom portion 28. Mechanical fasteners can include, for example, nuts and bolts. Other types of mechanical fasteners are contemplated herein.

In certain embodiments, the tank 16 can include an opening 32. The opening 32 can extend through the outer wall 20 into the receptacle. In certain embodiments, the opening 32 can be in the shape of a square, rectangular, or other shape. The opening 32 can provide a pathway for filling a liquid within the tank 16. In certain embodiments, the opening 32 can be used in conjunction with a lid or plug for enclosing the tank 16 to contain liquid therein.

Figure 3:
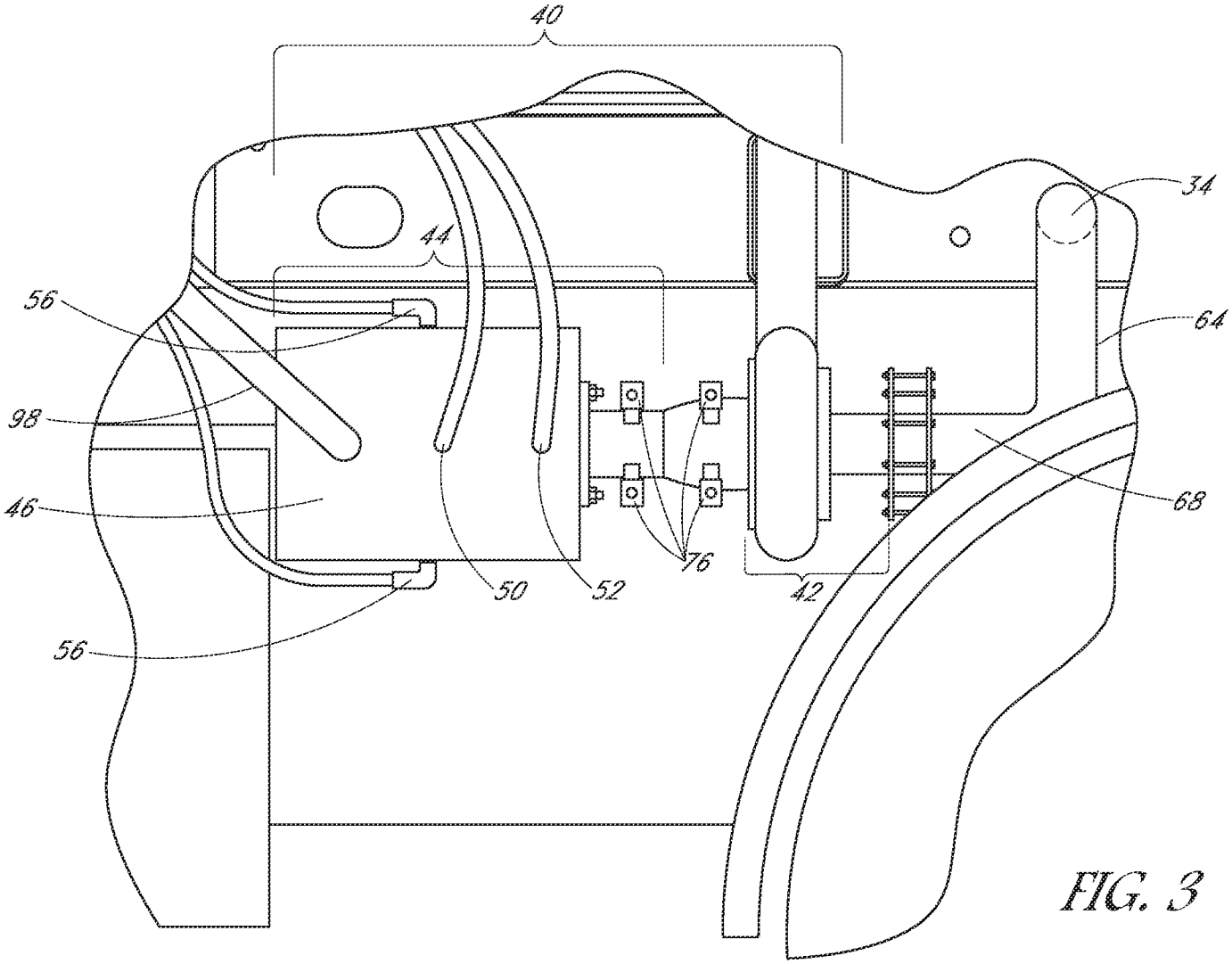
FIG. 3 is an enlarged view of the pump system from FIG. 2 that includes a motor with a coolant or water jacket.
Figure 4:
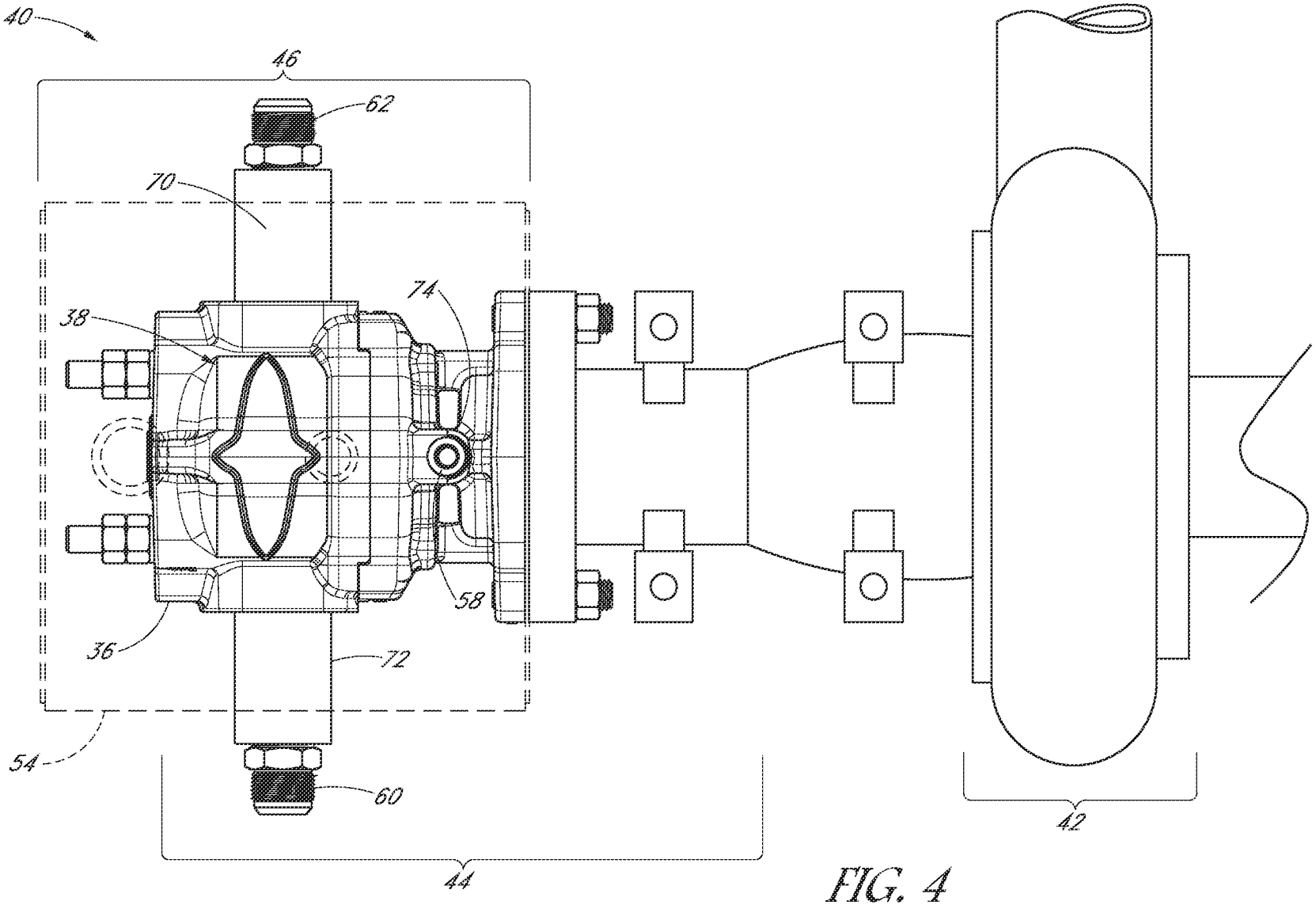
FIG. 4 is an enlarged view of a portion of FIG. 3 with the water jacket of the motor shown in dashed lines.

FIG. 3 is an enlarged view of the pump system 40 from FIG. 2. In certain embodiments, the pump system 40 includes a liquid end 42 and a power frame 44. In certain embodiments, the liquid end 42 and the power frame 44 are set up in a direct drive configuration. In certain embodiments, the power frame 44 includes a motor 46 with an inner housing 36 (FIG. 4) and a coolant or water jacket 54 (FIG. 4). In certain embodiments, the power frame 44 includes one or more legs 76. The legs 76 can be used to in part secure the power frame 44 to the truck 10.

In certain embodiments, the flow of liquid from the tank 16 to an inlet pipe 68 is drawn from the tank 16 via tank outlet 64. More specifically, in certain embodiments, gravity in combination with rotation of an impeller within the liquid end 42 draws the liquid from the tank 16. In certain embodiments, the flow entering the tank outlet 64 then passes through a valve before entering the inlet pipe 68. In this way, a user can control the volume of liquid flowing from the tank 16 to the inlet pipe 68. Of course, the described pipes and their connections are only exemplary and other arrangements of pipes, valves, and/or connectors are contemplated and fall within the disclosure herein.

In certain embodiments, the tank 16 can also include a drain 34. In certain embodiments, the drain 34 is disposed in the bottom portion 28 of the tank 16. In certain embodiments, the drain 34 can have a diameter sized to provide sufficient flow to feed the pump system 40. As is illustrated in the exemplary embodiment of FIG. 3, the drain 34 feeds into the tank outlet 64.

FIG. 4 is an enlarged view of a portion of the pump system 40 from FIG. 3 with the coolant or water jacket 54 of the motor 46 shown in dashed lines. In certain embodiments, the water jacket 54 surrounds at least a portion of the inner housing 36 of the motor 46. In certain embodiments, the water jacket 54 is at least partially filled with a liquid or coolant. In such an embodiment where the liquid or coolant at least partially fills the water jacket 54 and the temperature of the inner housing 36 is higher than the temperature of the liquid or coolant, thermal energy transfers from the inner housing 36 to the liquid or coolant. In embodiments where the liquid or coolant is not being circulated within the water jacket 54, the heat transfer can be predominantly by conduction.

In certain embodiments, the liquid or coolant is circulated within the water jacket 54. By circulating the liquid or coolant in the water jacket 54, additional heat transfer can occur from the inner housing 36 to the liquid or coolant. In certain embodiments, a size of the water jacket 54 can be selected to provide a volume of the liquid or coolant that achieves a desired rate of heat transfer. In certain embodiments, the water jacket 54 includes one or more circulatory pumps disposed in the water jacket 54 to locally circulate the liquid or coolant in the water jacket 54 and increase convection.

In certain embodiments, the liquid or coolant is circulated between a reservoir (e.g., tank 16) external to the water jacket 54 and inside the water jacket 54. In certain embodiments, the reservoir can be a dedicated reservoir for the water jacket 54. In certain embodiments, the reservoir can be located adjacent to the water jacket 54, spaced from the water jacket 54, or entirely separate from the truck 10.

The reservoir can store any liquid, coolant, or other heat transfer fluid. In certain embodiments, the reservoir contains water, ethylene glycol, diethylene glycol, propylene glycol, or any other heat transfer fluid. In certain embodiments where below-ambient temperatures are desired, a refrigerant can be used as the liquid or fluid.

In the illustrated embodiments, the reservoir is in the form of the tank 16 that is also used to carry, for example, water. In such an embodiment, the liquid or coolant is circulated between the tank 16 and the water jacket 54. Such an embodiment may be advantageous due to the typically low temperature of the liquid in the tank 16, the large volume of the low temperature liquid, and the close proximity of the tank 16 to the water jacket 54.

In certain embodiments, the water jacket 54 of the illustrated embodiment increases a rate of heat transfer from the inner housing 36 to the liquid or coolant circulating in the water jacket 54 which results in better heat extraction from the motor 46. In certain embodiments, the increased heat extraction from the motor 46 also reduces motor 46 temperatures under high load, which can enhance the durability limit of the motor 46.

In certain embodiments, circulating water from the tank 16 through the water jacket 54 can reduce operating temperatures of the motor 46 because heat transfers from the motor 46 to the liquid in the tank 16. In certain embodiments where the water for cooling the motor 46 comes from the tank 16, any need for an external heat exchanger to cool the liquid exiting the water jacket 54 can be reduced or entirely extinguished. In this way in certain embodiments, the reliability of the motor 46 when operated with a heat exchanger for the liquid or coolant is maintained even if a heat exchanger is removed from the cooling system for the water jacket 54. In certain embodiments, the heat transfer from the motor 46 to the liquid in the tank 16 compensates for the loss of the heat exchanger in the cooling system for the water jacket 54. In certain embodiments, the heat exchanger is employed in the cooling system.

In certain embodiments, the increased heat dissipation capacity of the water jacket 54 can also facilitate making the motor 46 from a lighter weight material, such as aluminum. Of course, the motor 46 can be made from other materials such as iron and steel without deviating from the scope of this disclosure.

In certain embodiments, it may be advantageous to align a flow path for the liquid or coolant entering the water jacket 54 through the water jacket 54. For example, in certain embodiments, a flow path of the liquid or coolant entering the water jacket 54 is selected to cause the liquid or coolant to contact the inner housing 36 of the motor 46 before completely mixing with the liquid or coolant already in the water jacket 54. In certain embodiments, the motor 46 further comprises a baffle disposed between the outer surface of the inner housing 36 and the water jacket 54. In certain embodiments, the baffle defines a flow path for conveying water through the water jacket 54 between the water inlet 82 and the water outlet 84.

In certain embodiments, the pump system 40, the tank 16, and/or connecting lines include one or more pumps configured to facilitate the circulation of the liquid or coolant between the tank 16 and the water jacket 54. The one or more pumps can be a part of the pump system 40 or a separate pump. In certain embodiments, the pump pressurizes the liquid or coolant flowing in the water jacket 54.

In certain embodiments, the pressurized liquid or coolant flows from inside the tank 16 to the water jacket 54 via inlet line 50 and then returns warmed water to the tank 16 via return line 52 as shown in FIG. 3. In certain embodiments where the water jacket 54 is disposed outside the tank 16, the inlet line 50 and the return line 52 can pass through the outer wall 20 of the tank 16. For example, the inlet line 50 and the return line 52 can pass through respective openings in the outer wall 20. In certain embodiments, the inlet line 50 and the return line 52 pass through the outer wall 20 at locations close to the water jacket 54.

In certain embodiments, the pump system 40 includes a drain line 98. In certain embodiments, the drain line 98 connects to a drain port 58 in the motor 46 after passing through the water jacket 54.

In certain embodiments where the one or more pumps is a part of the pump system 40, a valve can direct a portion of the water exiting the liquid end 42 of the pump system 40 to the water jacket 54. Depending on the desired operation in certain embodiments, it is possible to prioritize directing more of the water leaving the liquid end 42 through the water jacket 54 to more quickly cool the water jacket 54 of the motor 46 before the water is directed to the control valves 78 of the truck 10.

As most clearly shown in FIG. 4, in certain embodiments, the motor 46 comprises a mechanical actuator 38 configured to provide rotational energy to the liquid end 42 of the pump system 40. In certain embodiments, the motor 46 can be an electric motor, a pneumatic motor, or a hydraulic motor. Pneumatic motors and hydraulic motors both rely on a working fluid. The working fluid for a pneumatic motor is in the form of a gas while the working fluid for a hydraulic motor is in the form of an incompressible liquid.

The embodiment of the pump system 40 illustrated in FIG. 4 includes a motor 46 configured as a hydraulic motor 46. Exemplary types of hydraulic motors 46 include gear motors, vane motors, piston motors, gerotor motors, and gerolor motors as understood by a person having ordinary skill in the art. This disclosure contemplates the use of any type of motor 46 and in the case where the motor 46 is a hydraulic motor 46, contemplates the use of any type of hydraulic motor 46. Selection of the type of motor 46 can be dependent on a specific environment or design operating pressure. Thus, while the disclosure recites hydraulic motor 46 for ease of explanation, the disclosure is not limited to the motor 46 of the pump system 40 being a hydraulic motor 46. The pump system 40 can be any type of motor useful for generating rotational energy known to a person having ordinary skill in the art.

The liquid end 42 of the pump system 40 can include any type of pump, for example, a positive displacement pump, a centrifugal pump, or an axial-flow pump. A positive displacement pump moves fluid by trapping a fixed amount and forcing or displacing that trapped volume into the discharge pipe. A centrifugal pump changes a direction of flow of the fluid by ninety degrees as the fluid flows over an impeller. In an axial flow pump, the direction of flow is unchanged through the pump. The embodiment of the pump system 40 illustrated in FIG. 4 is a centrifugal pump. Further, the illustrated pump is a single-stage pump. Of course, the disclosure is not limited to the pump system 40 being a centrifugal pump or single-stage. The pump system 40 can be any type of pump useful for converting rotational energy to energy in a moving fluid known to a person having ordinary skill in the art.

Figure 5A:
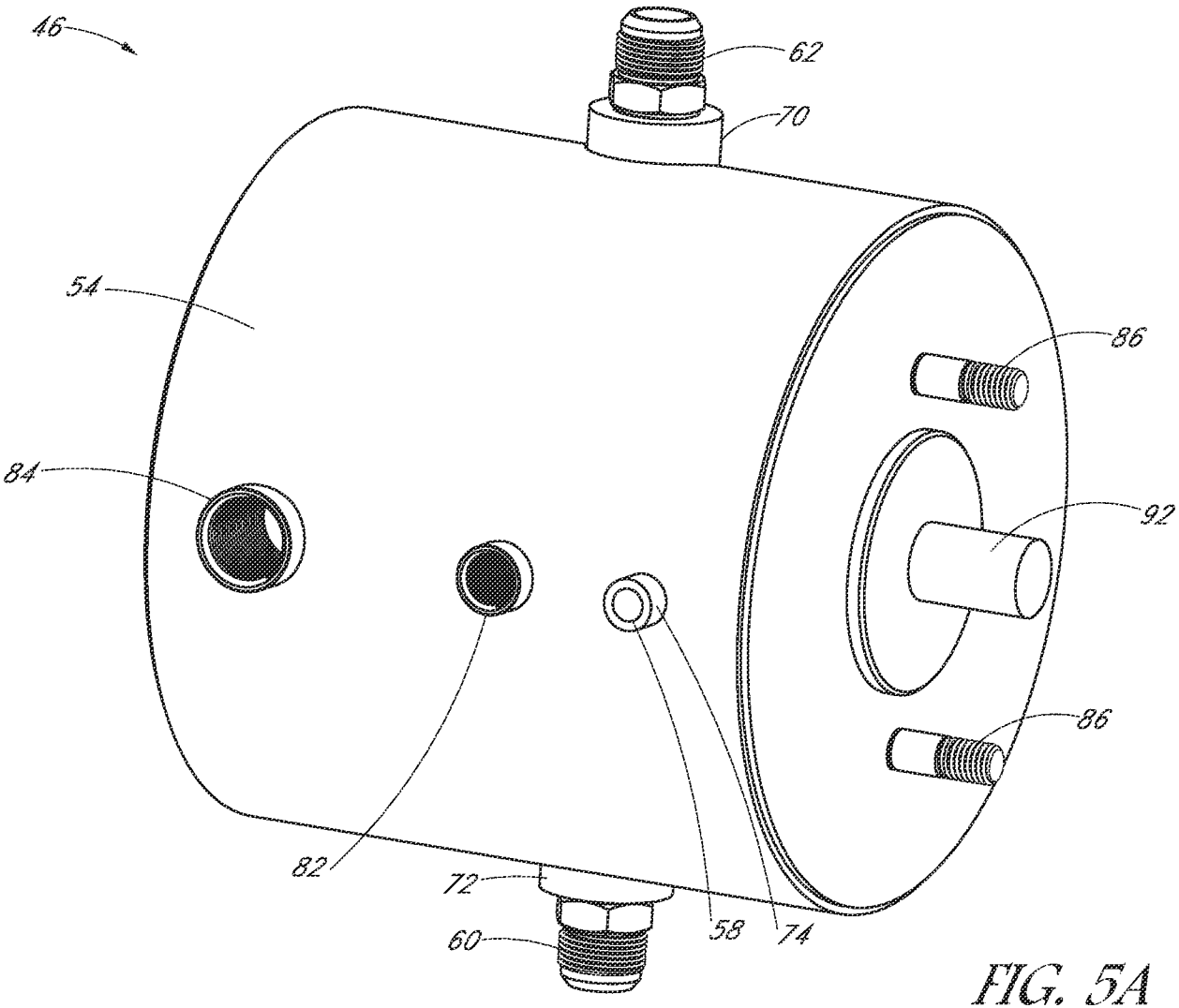
FIG. 5A is a perspective view of the motor from FIG. 4.

The hydraulic motor 46 or rotary actuator converts the energy of a working fluid flowing from an inlet 60 to an outlet 62 into mechanical power. The hydraulic motor 46 then applies the mechanical power to the liquid end 42 of the pump system 40 via a drive shaft 92 (FIG. 5A). In certain embodiments, the mechanical power is used to drive an impeller of the liquid end 42 through the drive shaft 92. In this way, at least some of the energy of the working fluid entering the hydraulic motor 46 via the inlet 60 is eventually converted to hydraulic power for pumping the liquid from the tank 16. In certain embodiments, the drive shaft 92 is rotated by the hydraulic motor 46 on one end which rotates the liquid end 42 of the pump system 40 at the opposite end of the drive shaft 92.

In certain embodiments, the motor 46 further comprises one or more pipes connecting ports in the inner housing 36 of the motor 46 through the water jacket 54. For example, the motor 46 illustrated in FIG. 4 can include a first pipe 70 connecting a port in the inner housing 36 to the outlet 62, a second pipe 72 connecting a port in the inner housing 36 to the inlet 60, and/or a third pipe 74 connecting a port in the inner housing 36 to the drain port 58.

In certain embodiments, one or more of the lumens of each of the first, second, or third pipes 70, 72, and 74 are combined into a multi-lumen pipe.

In certain embodiments, the pump system 40 further includes a reservoir 48 (FIG. 2) to contain the working fluid for the motor 46. In certain embodiments and as shown in FIG. 3, quick connect couplings 56 provide hydraulic connections between the reservoir 48 and the motor 46.

In certain embodiments, the reservoir 48 is configured to cool the working fluid used to drive the motor 46. Exemplary working fluids include hydraulic fluid and food grade oil. For example, a food grade oil specified by the National Sanitation Foundation (NSF) can be employed as the working fluid.

In certain embodiments, the reservoir 48 for the working fluid is placed in close proximity to the tank 16 to promote heat transfer from the working fluid in the reservoir 48, through a wall/barrier between the working fluid and the liquid in the tank 16, and finally to the liquid itself. For example, energy can transfer via conduction through the wall/barrier.

As is most clearly illustrated in FIG. 2, in certain embodiments, the reservoir 48 is disposed outside the tank 16 and on the front head 22. Of course, the reservoir 48 need not be placed outside the tank 16 or on the front head 22. In other embodiments, the reservoir 48 is disposed inside the tank 16.

In other embodiments, the reservoir 48 is disposed outside the tank 16 and on the rear head 24. In other embodiments, the reservoir 48 is disposed on any of the one or more surfaces of the outer wall 20. For example, the reservoir 48 can be placed on the bottom portion 28 of the tank 16. It may be advantageous to dispose the reservoir 48 in a lower region of the tank 16 to maintain close proximity between the working fluid and the liquid in the tank 16 as the level of the liquid drops in the tank 16.

In certain embodiments, the wall/barrier is the outer wall 20. In certain other embodiments, there is no outer wall 20 in the region of the reservoir 48. Instead, a wall of the reservoir 48 is the wall/barrier between the working fluid in the reservoir 48 and the liquid in the tank 16. In certain other embodiments, the wall/barrier is the wall of the reservoir 48 and the outer wall 20.

After passing through the hydraulic motor 46, the working fluid exits the outlet 62 and returns to the reservoir 48.

In certain embodiments, the pump system 40 includes a control which allows the user to adjust the flow of the working fluid entering the inlet 60 of the motor 46.

Referring to FIG. 3, in certain embodiments, the flow from the inlet pipe 68 enters the liquid end 42 of the pump system 40. The inlet pipe 68 and the tank outlet 64 can be connected via any conventional means known in the art.

In certain embodiments, the pump system 40 includes a centrifugal pump for delivering the liquid at high pressure. The pump system 40 further includes a pump outlet for the high pressure liquid. In this way, the pressure of the liquid exiting the pump outlet is higher than the pressure of the liquid entering the pump.

The pump system 40 includes the liquid end 42 and the power frame 44. In certain embodiments, disposed within the liquid end 42 is the impeller. In certain embodiments, the impeller includes several vanes and is rotatable around a rotational axis of the drive shaft 92. In certain embodiments, the impeller comprising a rotor in the shape of a disc or ring, as well as the several vanes mounted on the rotor. In certain embodiments, the several vanes are made from a metal or plastic.

As explained above, in certain embodiments, the hydraulic motor 46 drives the impeller. The term "centrifugal pumps" refers to those rotational or centrifugal pumps in which the fluid to be delivered flows in the direction of the rotational axis of the drive shaft 92 and the impeller and leaves the liquid end 42 in a radial or tangential direction via the pump outlet. In certain embodiments, a pump outlet pipe is in flow communication with the pump outlet and directs the high pressure flow of liquid to one or more control valve 78.

FIG. 5A is a perspective view of the motor 46 from FIG. 4. In certain embodiments, the motor 46 includes the inner housing 36 (FIG. 4) and the water jacket 54. In certain embodiments, the water jacket 54 comprises a water inlet 82 and a water outlet 84. In certain embodiments, the water inlet 82 and the water outlet 84 have the same dimeter. In the illustrated embodiment, the water outlet 84 has a diameter that is greater than a diameter of the water inlet 82. In other embodiments, the water outlet 84 has a diameter that is smaller than a diameter of the water inlet 82. Of course, the water inlet 82 and the water outlet 84 need not be round and can have any other shape.

The water inlet 82 can include a thread or other structure to secure the water inlet 82 to the inlet line 50. Similarly, the water outlet 84 can include a thread or other structure to secure the water outlet 84 to the return line 52.

Figure 5B:
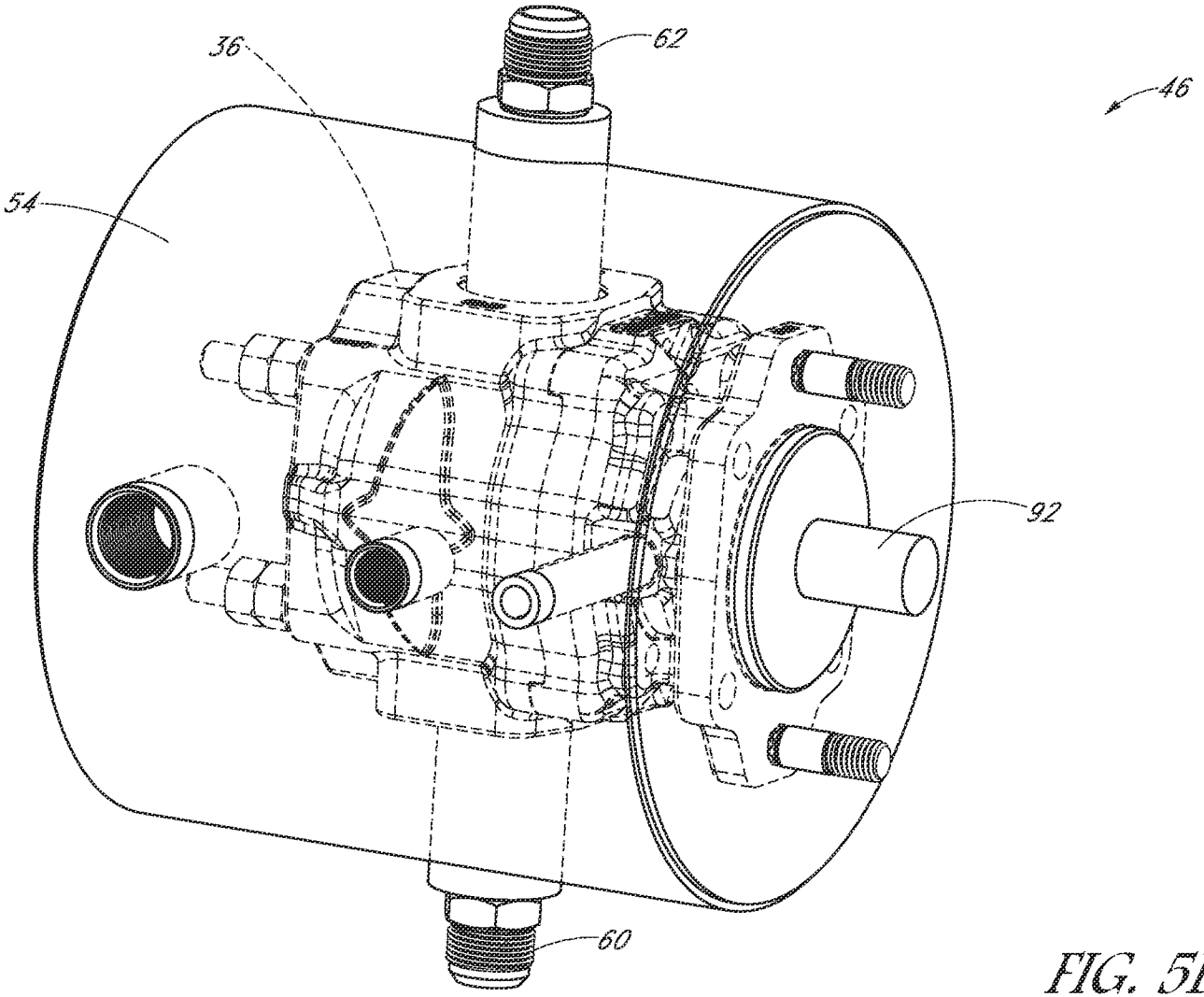
FIG. 5B is similar to FIG. 5A except the water jacket is transparent to show an inner housing of the motor in dashed lines.

FIG. 5B is similar to FIG. 5A except the water jacket 54 is transparent to show the inner housing 36 of the motor 46 in dashed lines. In certain embodiments, the water jacket 54 surrounds at least a portion of the inner housing 36 of the motor 46. The water jacket 54 can be formed in any shape including round, square, cylindrical, oval, or other shapes. In certain embodiments, the water jacket 54 is sized greater than a size of the inner housing 36 to allow the liquid or coolant to circulate around an outer surface of the inner housing 36 as the liquid or coolant flows from the water inlet 82 to the water outlet 84.

In certain embodiments, it may be advantageous to align a flow path for the liquid or coolant entering the water jacket 54 through the water jacket 54. For example, in certain embodiments, a flow path of the liquid or coolant entering the water jacket 54 is selected to cause the liquid or coolant to contact the inner housing 36 of the motor 46 before completely mixing with the liquid or coolant already in the water jacket 54.

In certain embodiments, the motor 46 further comprises a baffle disposed between the outer surface of the inner housing 36 and the water jacket 54. In certain embodiments, the baffle defines a flow path for conveying water through the water jacket 54 between the water inlet 82 and the water outlet 84.

As explained above, the pump system 40, the tank 16, and/or connecting lines can include one or more pumps configured to facilitate the circulation of the liquid or coolant between the tank 16, the water jacket 54, and within the water jacket 54. The one or more pumps can be a part of the pump system 40 or a separate pump. The pump pressurizes the liquid or coolant flowing into the water inlet 82 of the water jacket 54.

The water jacket 54 can comprise aluminum, plastic, cast iron, bronze, or any other material. In certain embodiments, the water jacket 54 is cast aluminum. In certain embodiments, the water jacket 54 comprises iron or steel. The selection of material for the water jacket 54 may be dictated in part by requirements for corrosion, erosion, and/or high temperature operation.

In certain embodiments, the motor 46 is a portion of the power frame 44. In such embodiments, the motor 46 and/or the other portion of the power frame 44 can comprise one or more fasteners 86 configured to couple the motor 46 to the remainder of the power frame 44. In the illustrated embodiment, the motor 46 comprises the one or more fasteners 86 in the form of studs. Complementary nuts are attached to the studs securing the motor 46 to the remainder of the power frame 44. In the illustrated embodiment, the drive shaft 92 of the mechanical actuator 38 is disposed between the studs in FIG. 5A and applies the mechanical power to the liquid end 42 of the pump system 40.

In certain embodiments, one or more seals can be disposed between the motor 46 and the remainder of the power frame 44 to inhibit leakage from the water jacket 54 at the interface with the remainder of the power frame 44. One or more seals can be further disposed at the interfaces where the first pipe 70, the second pipe 72, and/or the third pipe 74 pass through the water jacket 54 to prevent leakage from the water jacket 54.

Figure 5C:
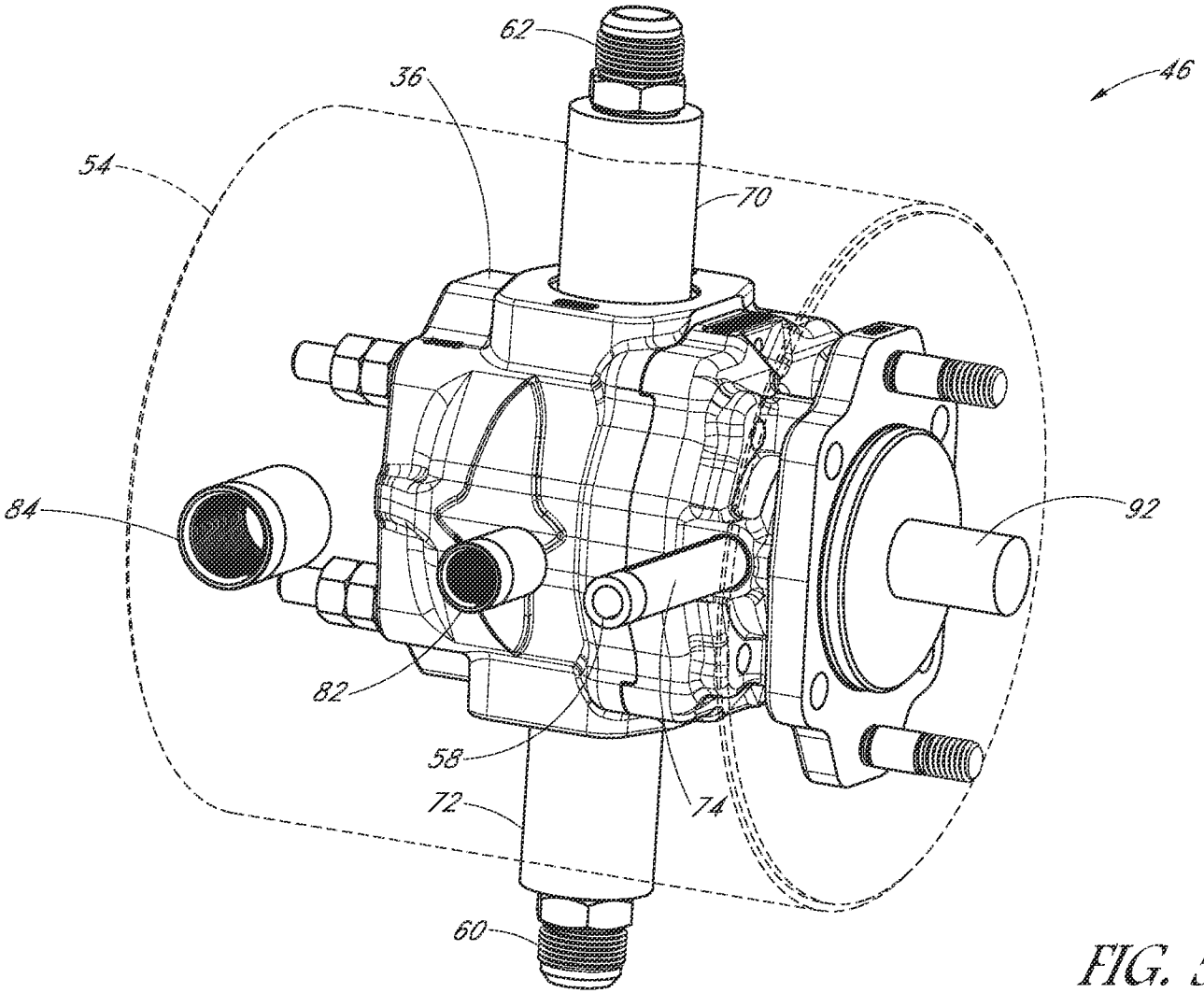
FIG. 5C is similar to FIG. 5A except the water jacket is shown in dashed lines with the inner housing of the motor in solid lines.

FIG. 5C is similar to FIG. 5A except the water jacket 54 is shown in dashed lines with the inner housing 36 of the motor 46 in solid lines. The hydraulic motor 46 can have a fixed or variable displacement. For example, in certain embodiments, hydraulic motors 46 that have a fixed displacement rotate the drive shaft 92 at a constant speed while a constant input flow is provided. In certain embodiments, hydraulic motors 46 that have a fixed displacement provide constant torque. In contrast, hydraulic motors 46 that have a variable displacement can varying their flow rates by changing the displacement. In this way, the hydraulic motor 46 is able to output variable torque and speed. In certain embodiments, the hydraulic motor 46 operates bidirectional or unidirectional. The flow rate of the hydraulic motor 46 is the volume of the working fluid entering the hydraulic motor 46 per unit of time.

As illustrated in FIG. 5C, the first pipe 70, the second pipe 72, and/or the third pipe 74 can each have similar or different lengths. For example, the first pipe 70, the second pipe 72, and/or the third pipe 74 can have any length depending on the size and shape of the motor 46 and of the water jacket 54.

In certain embodiments, the inner housing 36 is sized and shaped to locate the ports in the inner housing 36 so the ports are in close proximity to the outer surface of the water jacket 54. In certain embodiments, the water jacket 54 is sized and shaped to locate regions of the water jacket 54 in close proximity to the ports in the inner housing 36. Accordingly, embodiments of the motor 46 need not include any of the first, second, or third pipes 70, 72, and 74 and instead the ports in the inner housing 36 can be in close proximity to or even pass through the water jacket 54 themselves.

Figure 6:
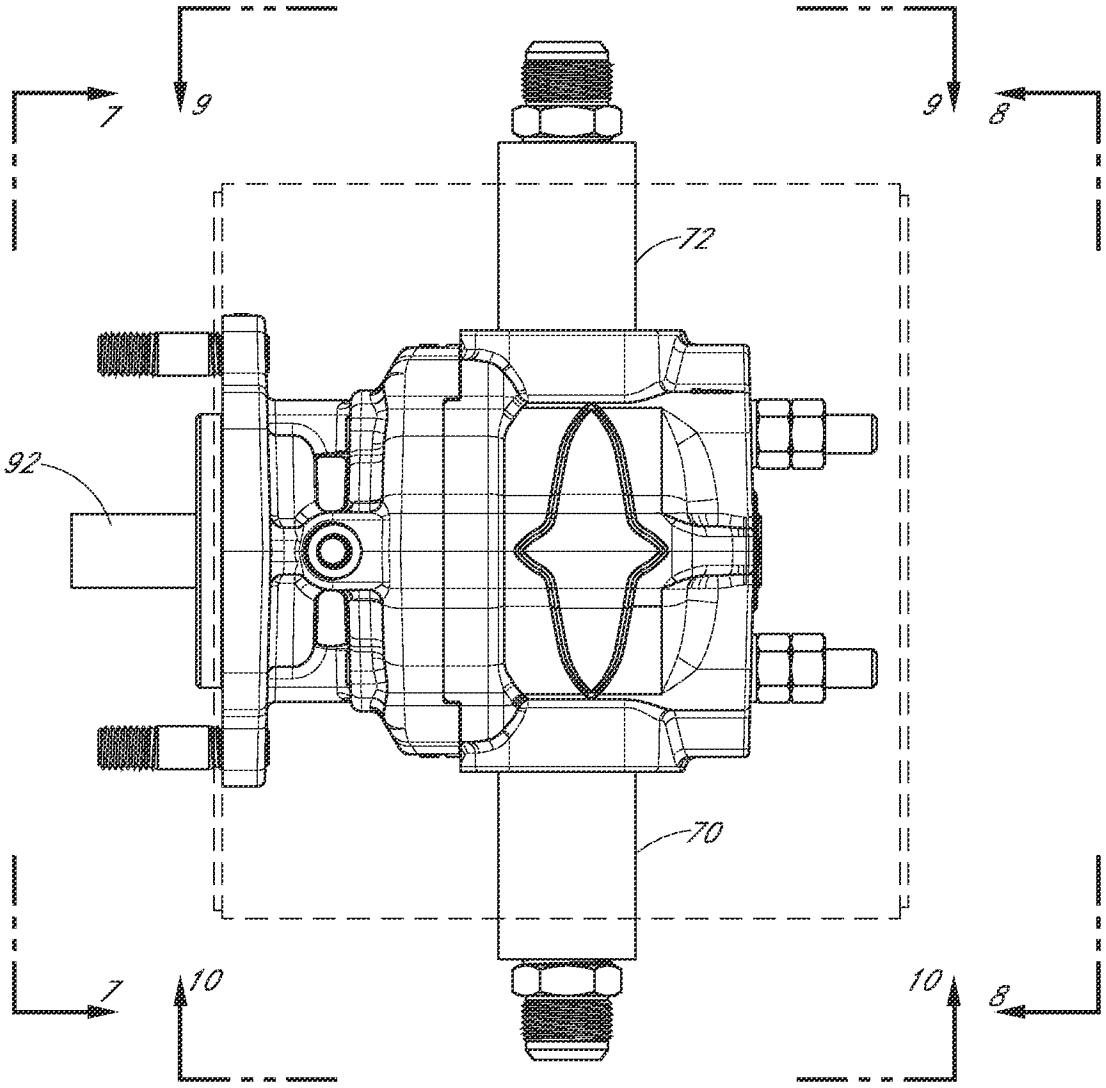
FIG. 6 is a plan view of the motor from FIG. 4.
Figure 7:
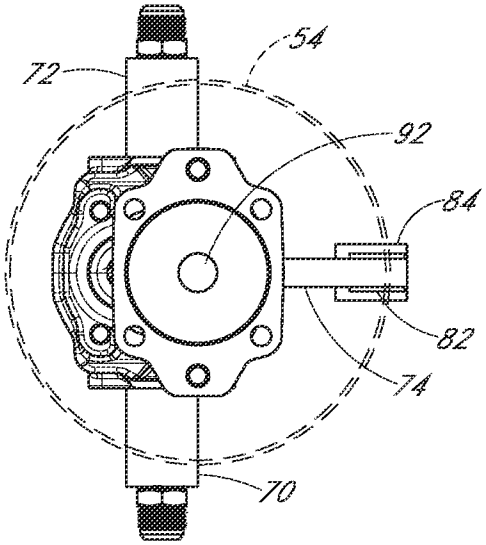
FIG. 7 is a front view of the motor from FIG. 4 taken along lines 7-7 in FIG. 6.

FIG. 6 is a plan view of the motor 46 from FIG. 4. FIG. 7 is a front view of the motor 46 from FIG. 4 taken along lines 7-7 in FIG. 6. As is illustrated in FIG. 7, in certain embodiments, the diameter of the water outlet 84 is greater than the diameter of the water inlet 82. In certain embodiments, a diameter of the third pipe 74 is less than the diameters of the water inlet 82 and the water outlet 84. The water inlet 82 is in flow communication with the inlet line 50 while the water outlet 84 is in flow communication with the return line 52.

Figure 8:
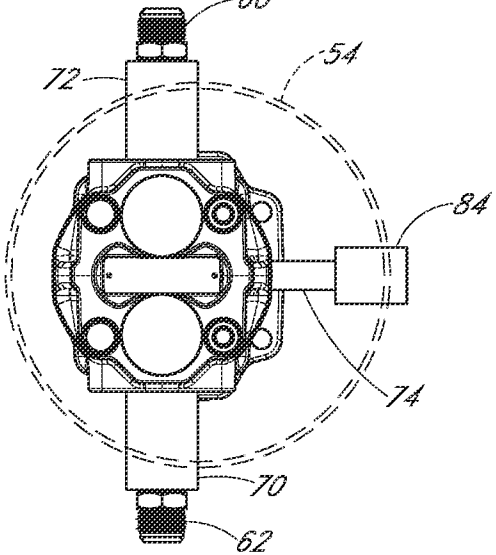
FIG. 8 is a rear view of the motor from FIG. 4 taken along lines 8-8 in FIG. 6.

FIG. 8 is a rear view of the motor 46 from FIG. 4 taken along lines 8-8 in FIG. 6. As is illustrated in FIG. 8, in certain embodiments, the water jacket 54 has a cylindrical shape which surrounds the inner housing 36. The liquid or coolant flows between the outer surface of the inner housing 36 and the inner surface of the water jacket 54. In certain embodiments, the inlet 60 and the outlet 62 are disposed on opposite sides of the motor 46. In other embodiments, the inlet 60 and the outlet 62 are disposed on the same side of the motor 46.

Figure 9:
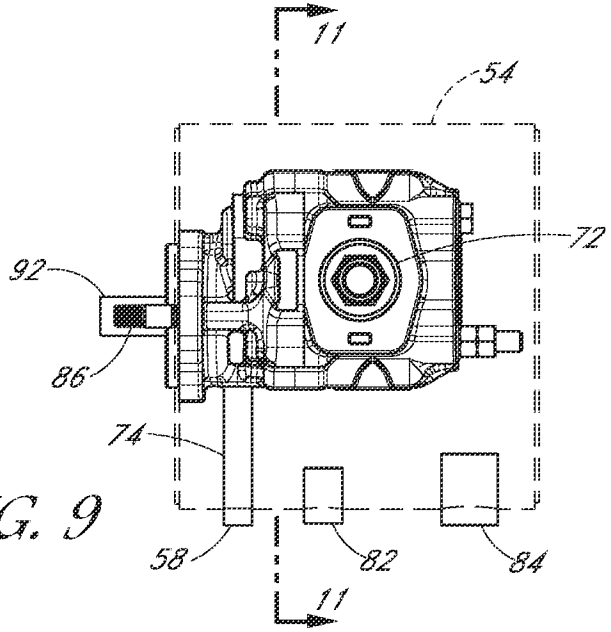
FIG. 9 is a top view of the motor from FIG. 4 taken along lines 9-9 in FIG. 6.
Figure 10:
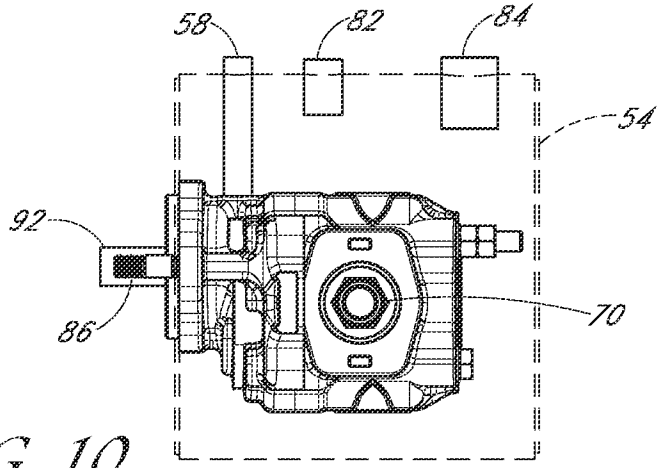
FIG. 10 is a bottom view of the motor from FIG. 4 taken along lines 10-10 in FIG. 6.

FIG. 9 is a top view of the motor 46 from FIG. 4 taken along lines 9-9 in FIG. 6. FIG. 10 is a bottom view of the motor 46 from FIG. 4 taken along lines 10-10 in FIG. 6. In certain embodiments, the water inlet 82 and the water outlet 84 can have the same length. In the illustrated embodiment, a length of the water inlet 82 is less than a length of the water outlet 84. In other embodiments, the length of the water inlet 82 is greater than the length of the water outlet 84. In the illustrated embodiment, the water outlet 84 has a diameter that is greater than a diameter of the water inlet 82. In other embodiments, the water outlet 84 has a diameter that is less than the diameter of the water inlet 82.

The inner housing 36 of the motor 46 can be centrally located within the water jacket 54 in certain embodiments. In the illustrated embodiment, the inner housing 36 is offset from a center of the water jacket 54. In the illustrated embodiment, the inner housing 36 is located within the water jacket 54 with the drive shaft 92 aligned with a centerline of the water jacket 54. Of course, other arrangements are possible and within the scope of this disclosure.

Figure 11:
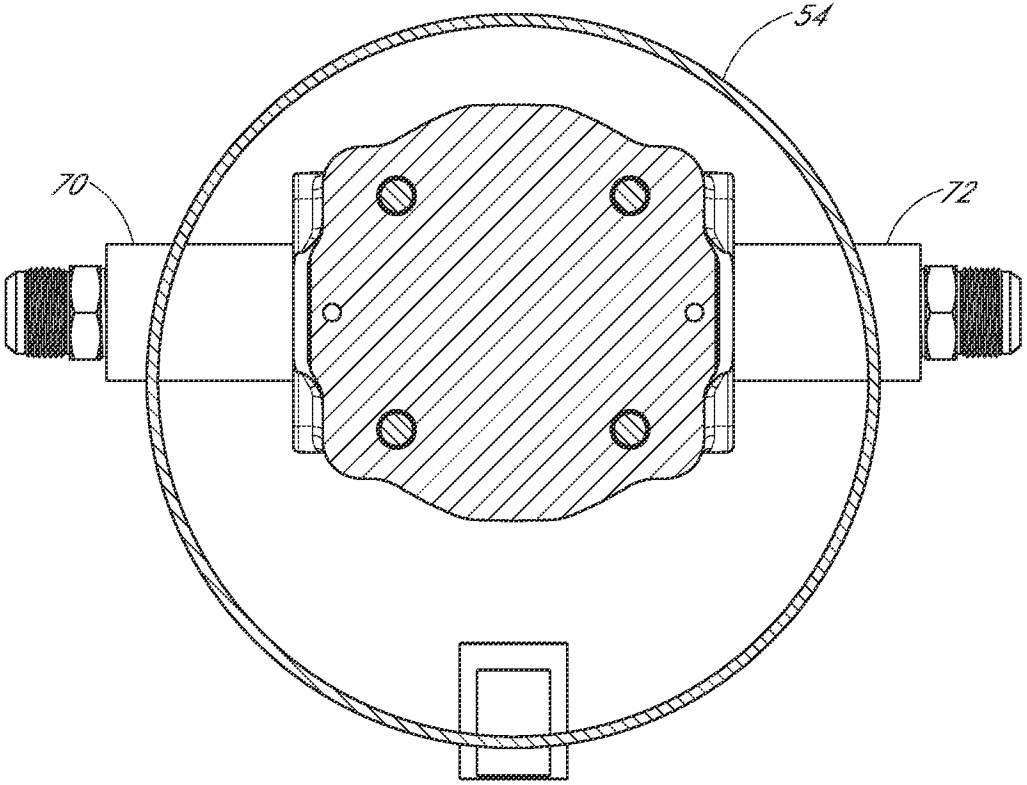
FIG. 11 is a section view taken along lines 11-11 in FIG. 9.

FIG. 11 is a section view taken along lines 11-11 in FIG. 9 and shows a close-up view of the first pipe 70 and the second pipe 72 offset from a center of the water jacket 54. Of course, the first pipe 70 and the second pipe 72 need not be offset in the direction as shown and can be offset in a different direction from the center of the water jacket 54. In other embodiments, the first pipe 70 and the second pipe 72 are aligned with the center of the water jacket 54. In other embodiments, one of the first or second pipes 70, 72 is offset from the center of the water jacket 54 while the other is aligned with the center of the water jacket 54.

In certain embodiments, a safety switch (not shown) is employed to alert the user when the liquid level in the tank 16 is low. When the liquid is at a low level the heat transfer rate between the motor 46 and the liquid or coolant in the water jacket 54 may be reduced. The safety switch can alert the user to take corrective action.

Figure 12:
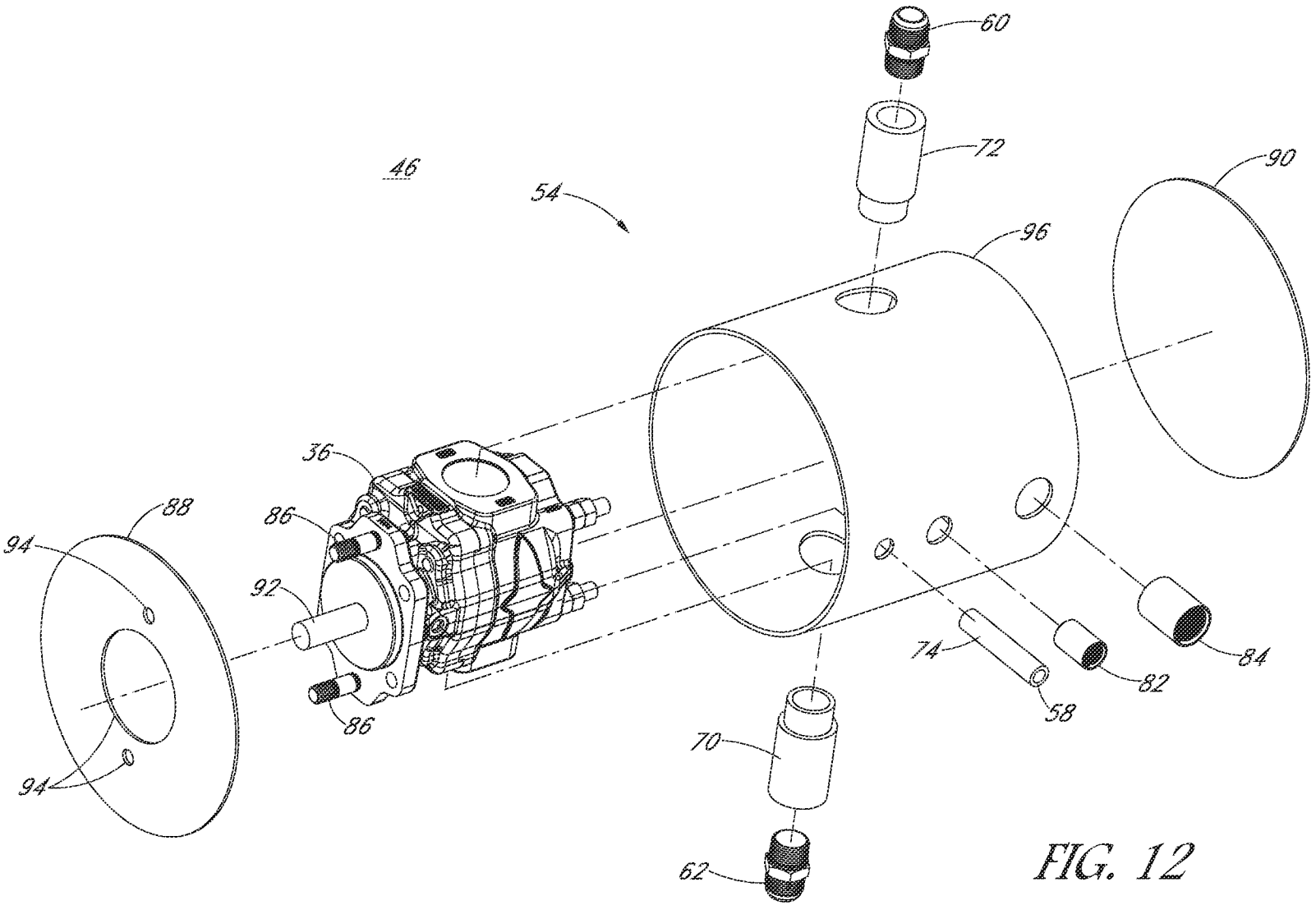
FIG. 12 is a perspective exploded view of the motor from FIG. 4.

FIG. 12 is a perspective exploded view of the motor 46 from FIG. 4. In certain embodiments, the motor 46 includes the inner housing 36 and the water jacket 54. In certain embodiments, the water jacket 54 surrounds at least a portion of the inner housing 36 of the motor 46.

In certain embodiments, the motor 46 further comprises the one or more pipes connecting ports in the inner housing 36 of the motor 46 through the water jacket 54. For example, the motor 46 illustrated in FIG. 12 can include the first pipe 70 connecting a port in the inner housing 36 to the outlet 62, the second pipe 72 connecting a port in the inner housing 36 to the inlet 60, and/or the third pipe 74 connecting a port in the inner housing 36 to the drain port 58. Once or more seals can be further disposed at the interfaces where the first pipe 70, the second pipe 72, and/or the third pipe 74 pass through the water jacket 54 to prevent leakage from the water jacket 54. In certain embodiments, the interfaces between the first pipe 70, the second pipe 72, and/or the third pipe 74 and the water jacket 54 are welded or secured by other means known to a person having ordinary skill in the art to prevent leakage from the water jacket 54.

In certain embodiments, the inlet 60 and the outlet 62 are disposed on opposite sides of the motor 46. The inlet 60 is in flow communication with the inlet line 50 while the outlet 62 is in flow communication with the return line 52. In certain embodiments, the drain port 58 connects to the drain line 98 through the water jacket 54.

In certain embodiments, the inner housing 36 can comprise the one or more fasteners 86 configured to couple the motor 46 to the remainder of the power frame 44. In the illustrated embodiment, the one or more fasteners 86 are studs.

In certain embodiments, the water jacket 54 comprises a body 96 having a cylindrical shape. Of course, the water jacket 54 can be formed in any shape including round, square, cylindrical, oval, or other shapes.

The water jacket 54 can comprise aluminum, plastic, cast iron, bronze, or any other material. In certain embodiments, the water jacket 54 is cast aluminum. In certain embodiments, the water jacket 54 comprises iron or steel. The selection of material for the water jacket 54 may be dictated in part by requirements for corrosion, erosion, and/or high temperature operation.

An outer surface of the water jacket 54 can have a unitary structure. In certain embodiments, the outer surface of the water jacket 54 comprises a plurality of components. For example, the outer surface of the water jacket 54 illustrated in FIG. 12 comprises the body 96 and at least two additional components, a first end plate 88 and a second end plate 90. In the illustrated embodiment, the first end plate 88 and the second end plate 90 are attached to opposite ends of the body 96 to form a volume of the water jacket 54.

In certain embodiments, the first end plate 88 further comprises one or more apertures 94. The one or more apertures 94 can be sized and shaped to allow, for example, the drive shaft 92 and/or the fasteners 86 to pass therethrough. In certain embodiments, the one or apertures 94 are sized to permit a circular seal portion of the inner housing 36 to pass therethrough.

In certain embodiments, the water jacket 54 further comprises the water inlet 82 and the water outlet 84. In certain embodiments, the water inlet 82 and the water outlet 84 are coupled to the body 96. For example, the water inlet 82 and the water outlet 84 can be welded to the body 96. In other embodiments, the water inlet 82 and the water outlet 84 are threaded into the body 96.

In certain embodiments, the water inlet 82 and the water outlet 84 have the same dimeter. In the illustrated embodiment, the water outlet 84 has a diameter that is greater than a diameter of the water inlet 82. In certain embodiments, the water inlet 82 and the water outlet 84 can have the same length. In the illustrated embodiment, a length of the water inlet 82 is less than a length of the water outlet 84. The water inlet 82 can include a thread or other structure to secure the water inlet 82 to the inlet line 50. Similarly, the water outlet 84 can include a thread or other structure to secure the water outlet 84 to the return line 52.

In certain embodiments, the water jacket 54 is at least partially filled with a liquid or coolant. In certain embodiments, the liquid or coolant is circulated within the water jacket 54. In certain embodiments, the liquid or coolant is circulated between the tank 16 and inside the water jacket 54. In the illustrated embodiments, the tank 16 is also used to carry, for example, water. The water jacket 54 of the illustrated embodiment increases a rate of heat transfer from the inner housing 36 to the liquid or coolant circulating in the water jacket 54 which results in better heat extraction from the motor 46.

The water jacket 54 is sized greater than a size of the inner housing 36 to allow the liquid or coolant to circulate around the inner housing 36 as the liquid or coolant flows from the water inlet 82 to the water outlet 84. The size of the water jacket 54 can be selected to provide a volume of the liquid or coolant that achieves a desired rate of heat transfer. In certain embodiments, the water jacket 54 includes one or more circulatory pumps disposed in the water jacket 54 to circulate the liquid or coolant in the water jacket 54 and increase convection.

Figure 13:
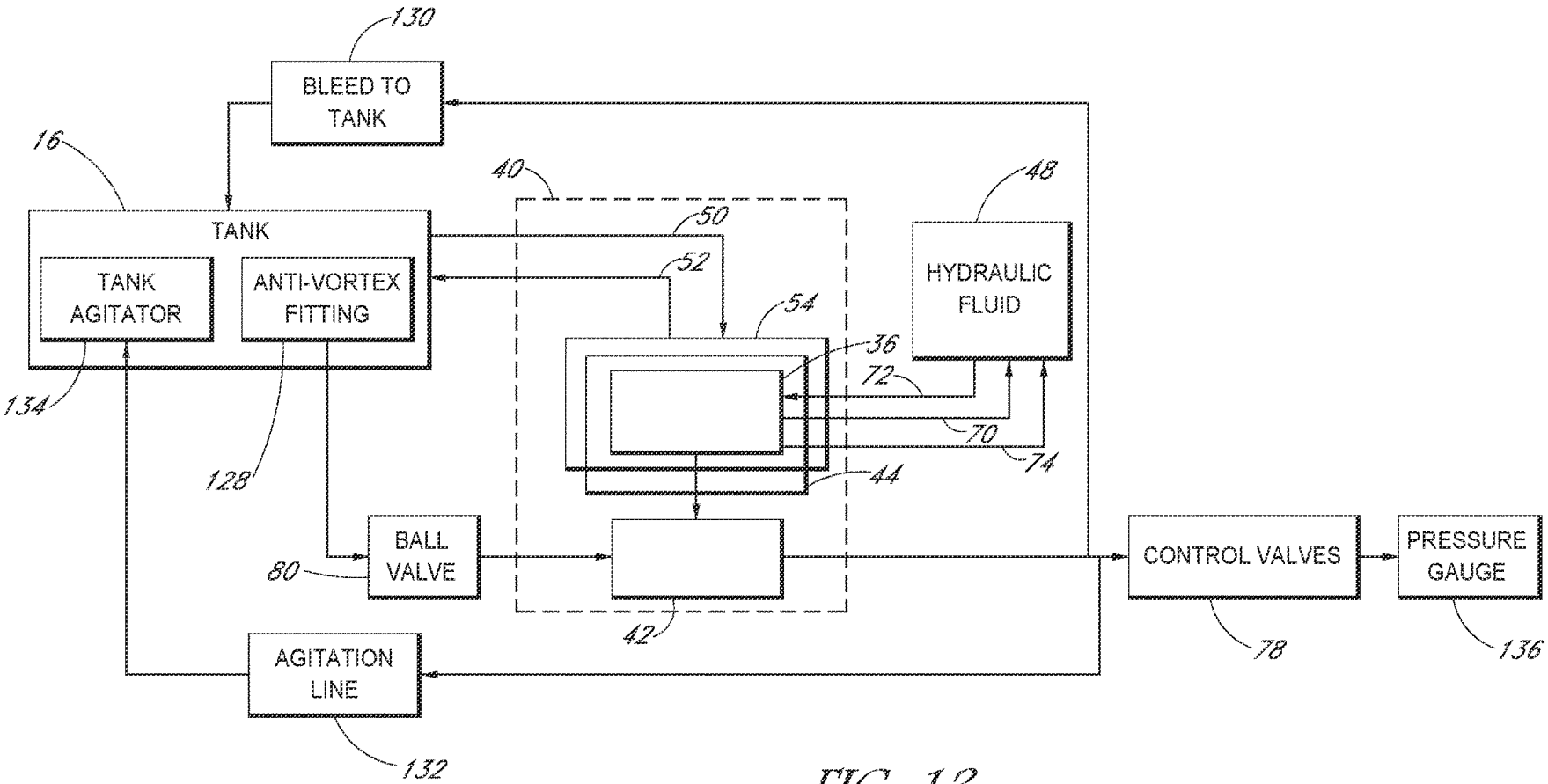
FIG. 13 is a schematic view of exemplary fluid flow paths to and from the pump system of FIG. 3.

FIG. 13 is a schematic view of exemplary fluid flow paths to and from the pump system 40 of FIG. 3. The pump system 40 generally includes the liquid end 42 and the power frame 44. In certain embodiments, water flow via an anti-vortex fitting 128 in the tank 16 is metered by a control valve 80, such as a ball valve, before the water enters the liquid end 42. In certain embodiments, the pump system 40 includes the shaft 92 which is in rotational engagement with the impeller in the liquid end 42 and the hydraulic motor 46 in the power frame 44.

In certain embodiments, the motor 46 of the power frame 44 is disposed inside the water jacket 54. In certain embodiments, the water jacket 54 surrounds at least a portion of the inner housing 36 of the motor 46. In certain embodiments, at least a portion of the power frame 44 is disposed outside the water jacket 54. For example, in certain embodiments, the portion of the power frame 44 disposed in the water jacket 54 is the hydraulic motor 46. Accordingly, in some embodiments, portions of the pump system 40 are disposed in and out of the water jacket 54.

In certain embodiments, the liquid or coolant flows from inside the tank 16 to the water jacket 54 via inlet line 50 and then returns as warmed water to the tank via return line 52 as shown in FIG. 13. Such an embodiment may be advantageous due to the typically low temperature of the liquid in the tank 16, the large volume of the low temperature liquid, and/or the close proximity of the tank 16 to the water jacket 54.

In certain embodiments, the water jacket 54 of the illustrated embodiment increases a rate of heat transfer from the inner housing 36 to the liquid or coolant circulating in the water jacket 54 which can result in better heat extraction from the motor 46. In certain embodiments, the increased heat extraction from the motor 46 also reduces motor 46 temperatures under high load, which can enhance the durability limit of the motor 46. In certain embodiments, circulating water from the tank 16 through the water jacket 54 can reduce operating temperatures of the motor 46 because heat transfers from the motor 46 to the liquid in the tank 16.

In certain embodiments, the pump system 40 includes a bleed to tank line 130. The bleed to tank line 130 can route flow of liquid from the liquid end 42 back to the tank 16.

In certain embodiments, the pump system 40 includes an agitation line 132 and a tank agitator 134 disposed in the tank 16. The agitation line 132 can route high pressure flow exiting the liquid end 42 back to the tank 16. In this way, excess liquid exiting the liquid end 42 is returned to the tank 16. A pressure relief or other design valve can be employed in the agitation line 132. In certain embodiments, the pump system 40 includes a pressure gage 136 to monitor the pressure of the liquid exiting the liquid end 42.

In certain embodiments, a spray system having spray booms (not shown) is employed downstream of the control valves 78. In this way, the truck 10 can transport and pump liquid from inside the tank 16 and spray or expel the pumped liquid at high pressure from the spray booms.

Certain Terminology

Terms of orientation used herein, such as "top," "bottom," "proximal," "distal," "longitudinal," "lateral," and "end," are used in the context of the illustrated example. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular," "cylindrical," "semi-circular," or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain examples include or do not include, certain features, elements, and/or steps. Thus, such conditional language is not generally intended to imply that features, elements, and/or steps are in any way required for one or more examples.

Conjunctive language, such as the phrase "at least one of X, Y, and Z," unless specifically stated otherwise, is otherwise understood with the context as used in general to convey that an item, term, etc. may be either X, Y, or Z.

Thus, such conjunctive language is not generally intended to imply that certain examples require the presence of at least one of X, at least one of Y, and at least one of Z.

The terms "approximately," "about," and "substantially" as used herein represent an amount close to the stated amount that still performs a desired function or achieves a desired result. For example, in some examples, as the context may dictate, the terms "approximately," "about," and "substantially," may refer to an amount that is within less than or equal to 10% of the stated amount. The term "generally" as used herein represents a value, amount, or characteristic that predominantly includes or tends toward a particular value, amount, or characteristic. As an example, in certain examples, as the context may dictate, the term "generally parallel" can refer to something that departs from exactly parallel by less than or equal to 20 degrees. All ranges are inclusive of endpoints.

Several illustrative examples of tanks have been disclosed. Although this disclosure has been described in terms of certain illustrative examples and uses, other examples and other uses, including examples and uses which do not provide all of the features and advantages set forth herein, are also within the scope of this disclosure. Components, elements, features, acts, or steps can be arranged or performed differently than described and components, elements, features, acts, or steps can be combined, merged, added, or left out in various examples. All possible combinations and subcombinations of elements and components described herein are intended to be included in this disclosure. No single feature or group of features is necessary or indispensable.

Certain features that are described in this disclosure in the context of separate implementations can also be implemented in combination in a single implementation. Conversely, various features that are described in the context of a single implementation also can be implemented in multiple implementations separately or in any suitable subcombination. Moreover, although features may be described above as acting in certain combinations, one or more features from a claimed combination can in some cases be excised from the combination, and the combination may be claimed as a subcombination or variation of a subcombination.

Any portion of any of the steps, processes, structures, and/or devices disclosed or illustrated in one example in this disclosure can be combined or used with (or instead of) any other portion of any of the steps, processes, structures, and/or devices disclosed or illustrated in a different example or flowchart. The examples described herein are not intended to be discrete and separate from each other. Combinations, variations, and some implementations of the disclosed features are within the scope of this disclosure.

While operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Additionally, the operations may be rearranged or reordered in some implementations. Also, the separation of various components in the implementations described above should not be understood as requiring such separation in all implementations, and it should be understood that the described components and systems can generally be integrated together in a single product or packaged into multiple products. Additionally, some implementations are within the scope of this disclosure.

Further, while illustrative examples have been described, any examples having equivalent elements, modifications, omissions, and/or combinations are also within the scope of this disclosure. Moreover, although certain aspects, advantages, and novel features are described herein, not necessarily all such advantages may be achieved in accordance with any particular example. For example, some examples within the scope of this disclosure achieve one advantage, or a group of advantages, as taught herein without necessarily achieving other advantages taught or suggested herein. Further, some examples may achieve different advantages than those taught or suggested herein.

Some examples have been described in connection with the accompanying drawings. The figures are drawn and/or shown to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various examples can be used in all other examples set forth herein. Additionally, any methods described herein may be practiced using any device suitable for performing the recited steps.

For purposes of summarizing the disclosure, certain aspects, advantages and features of the inventions have been described herein. Not all, or any such advantages are necessarily achieved in accordance with any particular example of the inventions disclosed herein. No aspects of this disclosure are essential or indispensable. In many examples, the devices, systems, and methods may be configured differently than illustrated in the figures or description herein. For example, various functionalities provided by the illustrated modules can be combined, rearranged, added, or deleted. In some implementations, additional or different processors or modules may perform some or all of the functionalities described with reference to the examples described and illustrated in the figures. Many implementation variations are possible. Any of the features, structures, steps, or processes disclosed in this specification can included in any example.

In summary, various examples of motor systems and related methods have been disclosed. This disclosure extends beyond the specifically disclosed examples to other alternative examples and/or other uses of the examples, as well as to certain modifications and equivalents thereof. Moreover, this disclosure expressly contemplates that various features and aspects of the disclosed examples can be combined with, or substituted for, one another. Accordingly, the scope of this disclosure should not be limited by the particular disclosed examples described above but should be determined only by a fair reading of the claims.

What is claimed is:

1. A hydraulic motor for driving a liquid end of a pump system, the pump system supported by a tank, the tank transporting and spraying liquid, the hydraulic motor comprising:

a housing having an outer surface;

a mechanical actuator disposed in the housing, the mechanical actuator converting hydraulic pressure of a fluid into torque and angular displacement;

an inlet port and an outlet port in the outer surface and in flow communication with the mechanical actuator, the inlet port being configured to supply the fluid to the mechanical actuator, the outlet port being configured to return the fluid leaving the mechanical actuator, a drain port in the outer surface;

an output shaft for transferring the torque and angular displacement to the liquid end of the pump system;

a flange coupled to the housing and configured to be secured relative to the liquid end of the pump system;

a water jacket surrounding at least a portion of the outer surface of the housing and having a water inlet and a water outlet;

a first pipe extending from the inlet port and through the water jacket, the first pipe having a first connector configured to releasably couple to a hydraulic supply line;

a second pipe extending from the outlet port and through the water jacket, the second pipe having a second connector configured to releasably couple to a hydraulic return line; and a third pipe extending from the drain port and through the water jacket, the third pipe having a third connector configured to releasably couple to a drain line.

2. The hydraulic motor of claim 1, wherein the water inlet and the water outlet are configured to connect to the tank to circulate water between the tank and the water jacket.

3. The hydraulic motor of claim 1, wherein a flow area of the water inlet is less than a flow area of the water outlet.

4. The hydraulic motor of claim 1, wherein the water jacket is sized greater than a size of the inner housing to allow water from the tank to circulate around the inner housing as the water flows from the water inlet to the water outlet.

5. The hydraulic motor of claim 1, wherein the water jacket has a cylindrical shape.

6. The hydraulic motor of claim 1, wherein the water jacket comprises aluminum.

7. The hydraulic motor of claim 1, further comprising one or more fasteners configured to couple the flange of the housing relative to the liquid end.

8. A hydraulic motor for driving a liquid end of a pump system, the hydraulic motor comprising:

an inner housing having an outer surface, the outer surface including a first end and a second end opposite the first end;

a mechanical actuator disposed in the inner housing;

a drive shaft extending from the first end and being configured to be rotated by the mechanical actuator;

a coolant jacket surrounding at least a portion of the outer surface of the inner housing to define a volume between the inner housing and the coolant jacket, at least a portion of the volume being between the inner housing and the second end; and an inlet port and an outlet port in flow communication with the mechanical actuator and accessible from outside the coolant jacket.

9. The hydraulic motor of claim 8, wherein the coolant jacket comprises an inlet and an outlet, and wherein the inlet and the outlet are configured to connect to a tank to circulate water between the tank and inside the coolant jacket.

10. The hydraulic motor of claim 8, further comprising:

a first pipe extending from the inlet port and through the water jacket; and a second pipe extending from the outlet port and through the water jacket.

11. The hydraulic motor of claim 10, further comprising:

a first connector configured to releasably couple the first pipe to a hydraulic supply line; and a second connector configured to releasably couple the second pipe to a hydraulic return line.

12. The hydraulic motor of claim 8, further comprising a flange coupled to the inner housing and configured to be secured relative to the liquid end of the pump system.

13. A hydraulic motor for driving a liquid end of a pump system, the hydraulic motor comprising:

an inner housing having an outer surface, the outer surface including a first end and a second end opposite the first end;

a mechanical actuator disposed in the inner housing;

a drive shaft extending from the first end and being configured to be rotated by the mechanical actuator; and a coolant jacket surrounding at least a portion of the outer surface of the inner housing to define a volume between the inner housing and the coolant jacket, at least a portion of the volume being between the inner housing and the second end.

14. The hydraulic motor of claim 13, wherein the volume is sized to circulate coolant within the coolant jacket so as to transfer heat from the inner housing to the coolant.

15. The hydraulic motor of claim 14, wherein the coolant is water.

16. The hydraulic motor of claim 14, wherein the coolant jacket comprises an inlet and an outlet, and wherein the coolant circulated within the coolant jacket enters the volume via the inlet and exits the volume via the outlet.

17. The hydraulic motor of claim 16, wherein the inlet and the outlet are further configured to connect to a tank to circulate the coolant between a tank and inside the coolant jacket.

18. The hydraulic motor of claim 13, wherein the pump system comprises a centrifugal pump.

19. The hydraulic motor of claim 13, wherein the hydraulic motor comprises an inlet and an outlet, and wherein the inlet and the outlet are configured to provide a flow path for a working fluid to flow between a reservoir and the hydraulic motor.

20. A coolant jacket for surrounding at least a portion of an inner housing of a hydraulic motor to form a volume between the inner housing and an inside surface of the coolant jacket, the inner housing including a first end and a second end opposite the first end, the hydraulic motor including a mechanical actuator and being configured to drive a liquid end of a pump system, a drive shaft extending from the first end and being configured to be rotated by the mechanical actuator, wherein at least a portion of the volume is between the inner housing and the second end.

21. The coolant jacket of claim 20, wherein the coolant jacket is sized and shaped relative to the inner housing to circulate coolant within the coolant jacket so as to transfer heat from the inner housing to the coolant.

22. The coolant jacket of claim 21, wherein the volume is configured to be in flow communication with a tank to circulate the coolant between the tank and inside the coolant jacket.

* * * * *